United States Patent [19]

Milburn

[11] Patent Number: 5,069,610

[45] Date of Patent: Dec. 3, 1991

[54] DRYWALL FINISHING TOOL ADAPTER

[76] Inventor: Virgil E. Milburn, P.O. Box 90998, Las Vegas, Nev. 89009

[21] Appl. No.: 595,174

[22] Filed: Oct. 9, 1990

[51] Int. Cl.[5] ..... B05C 5/02

[52] U.S. Cl. ..... 425/87; 15/235.8; 118/207; 401/5; 401/48; 401/87; 403/80; 403/109; 425/458

[58] Field of Search ..... 425/87, 458; 251/326–329; 405/103, 104; 403/80, 109; 15/235.8; 401/5, 48, 87, 171; 118/207

[56] References Cited

U.S. PATENT DOCUMENTS

| | | | |
|---|---|---|---|
| 629,725 | 7/1899 | Shaffer | 405/104 |
| 2,630,703 | 3/1953 | Sommers | 425/87 |
| 2,666,323 | 1/1954 | Ames | 425/87 |
| 2,711,098 | 6/1955 | Ames | 401/171 |
| 2,824,442 | 2/1958 | Ames | 425/87 |
| 2,889,965 | 6/1959 | Ames | 222/323 |
| 2,984,857 | 5/1961 | Ames | 425/87 |
| 3,186,056 | 6/1965 | Hoveland | 401/48 |
| 3,856,419 | 12/1974 | Levine | 401/5 |
| 3,932,101 | 1/1976 | Johnson et al. | 425/458 |
| 4,230,441 | 10/1980 | Heronema | 425/87 |
| 4,451,223 | 5/1984 | Mower | 425/458 |
| 4,516,868 | 5/1985 | Molnar | 425/87 |
| 4,907,955 | 3/1990 | Snipes | 425/87 |

*Primary Examiner*—Willard E. Hoag

*Attorney, Agent, or Firm*—Quirk, Tratos & Roethel

[57] ABSTRACT

Adapter for a mastic applicator and finishing tool flat box having a guide plate and corner guide assembly adapted to be mounted on opposite side and end walls of the flat box. Each corner guide is slidable between an extended position in which it has an end portion that can be projected beyond the end wall on which the assembly is mounted. The extended end portion is adapted to straddle a corner bead to guide the movement of the flat box along the corner bead during mastic filling of the corner bead. The corner guide end portion position in retracted position being out of contact with the wall board thereby permitting normal flat box mastic dispensing movement across the flat wall board surface. Each adapter guide plate having a flange portion overlying the flat box wall end on which it is mounted, the surface of the flange functioning as wear shoes adapted to ride on the abrasive wall board surfaces during normal flat box operation and during bead filling operation.

8 Claims, 2 Drawing Sheets

DRYWALL FINISHING TOOL ADAPTER

The present invention relates to applicators and finishing tools for applying mastic or plaster material to the wall joints and corner edges formed by gypsum wall board sections universally used in interior building walls, and more particularly to adapters that can be mounted on a conventional tools to enhance the utility of the tools in applying mastic to fill outside corner beads.

BACKGROUND OF THE INVENTION

Mastic or joint cement is applied to flat wall joints by tools popularly known to drywall finishers as "Ames Boxes" developed in the late 1940's and disclosed in U.S. Pat. Nos. 2,824,442; 2,984,857 and 3,888,611 to R. G. Ames. The Ames boxes greatly cut the time of finishing out flat joints but did little to speed the cost of finishing the outside corners. One of the more recent changes in the industry that has increased the cost of production to the contractor and piece worker has been the increased use of corner trim or corner beads. Corner beads are broadly defined as strips of plastic or metal to reinforce and finish corners, angles, or ends of wallboard.

Special tools have been developed for the application of mastic or cement to outside corners as disclosed in U.S. Pat. No. 4,230,441 to J. D. Heronema and U.S. Pat. No. 4,451,223 to M. F. Mower and E. R. Johnson. It should be readily apparent that such special tools may be costly to acquire and that maintenance required to prepare the tools for use and the cleanup after use will be time U.S. Pat. No. 4,907,955 to J. T. Snipes discloses a drywall finishing tool having pivoted corner guide members mounted on both opposite end walls of the housing in which the mastic is contained. The corner guide members can be used to engage an edge corner in some cases, especially where a wider application of plaster is desired. The pivoted guide members are intended to be moved to inactive positions, however, when other attachments on the tool are used. There is no suggestion that the pivoted guide members in the form disclosed are applicable to flat boxes of the type disclosed in the Ames U.S. Pat. No. 2,824,442. It is also noted that the pivoted guide members are applied to the Snipes U.S. Pat. No. 4,907,955 without any provision being made for friction wear shoes on the leading edges of the flat box end walls as disclosed in the above-mentioned Ames patent.

Many drywall craftsman applying mastic or cement to wall joints or as finishing coats on wall boards use an "Ames" flat box or other equivalent brand tools.

Accordingly, it is an object of the present invention to provide simple and inexpensive adapters to enable "Ames" flat boxes, or other like brand tools, to be used to successfully fill an outside corner bead.

It is further object to provide adapters that can easily be fitted to flat boxes sold under trade names such as "AMES", "TAPE TECH", "TAPE MASTER" and the like to enable the flat boxes to be used to fill corner beads at a much faster rate than the manual pan and knife methods normally used.

It is a further object of the present invention to provide adapters to be fitted to a flat boxes that will enable one person to fill more corner bead with mastic in an hour than could normally be done by two or three men using the conventional method.

It is yet a further object of the present invention to provide adapters for tools commonly used in the industry by drywall finishers that makes the tools capable of quality production increases without the expense of additional tools or flat box modifying devices.

It is yet a still further object of the invention to provide adapters that easily adapt already available and familiar tools to a further use as a tool for filling corner beads with mastic without affecting its originally designed use as a basic tool for filling flat joints and coating flat wall board surfaces.

It is yet a further object of the invention to provide adapters that allows flat boxes to be operated on wall board flat surfaces when the corner guide edges on the adapters are in a retracted position or on an outside corner bead when the guide edges by a simple adjustment are moved to an extended position.

It is yet a further object to provide adapters that can be fitted to the leading edges of the flat box end walls with provision for friction shoes and flexible troweling bar guide retention in sidewall recesses.

These and other objects will be apparent from the following disclosure of a preferred embodiment of the present invention.

SUMMARY OF THE INVENTION

The present invention comprises corner guide adapters that can be attached to one or both end walls of a flat box. "Flat box" is a generic trade name for a commonly used mastic-applying and finishing tool used in drywall construction. Each adapter comprises a base plate adapted to be mounted on an end wall of the flat box. The base member has side channels in which a outside corner guide member is slidably mounted for extension and retraction across the end wall.

When extended, the corner guide member has a portion that overlies the corner bead in position to guide the movement of the flat box to ensure proper application of a layer of mastic to fill the a corner bead as the flat box is moved along a flat wall surface in a direction parallel to and adjacent the corner bead.

When retracted, the corner guide member permits the flat box to be used in a normal manner for applying mastic or plaster to flat wall board joints and surfaces. The adapter does not have to be removed from the end wall after an extended corner guide has been used while filling a corner bead. All the operator has to do is to be sure that the corner guide is retracted if the flat box is to be used for finishing flat wall tape or surfaces.

BRIEF DESCRIPTION OF THE DRAWINGS

Further features and advantages of the present invention will become more apparent as this description proceeds, reference being had to the accompanying drawings, wherein.

DESCRIPTION OF A PREFERRED EMBODIMENT

Figure 1:
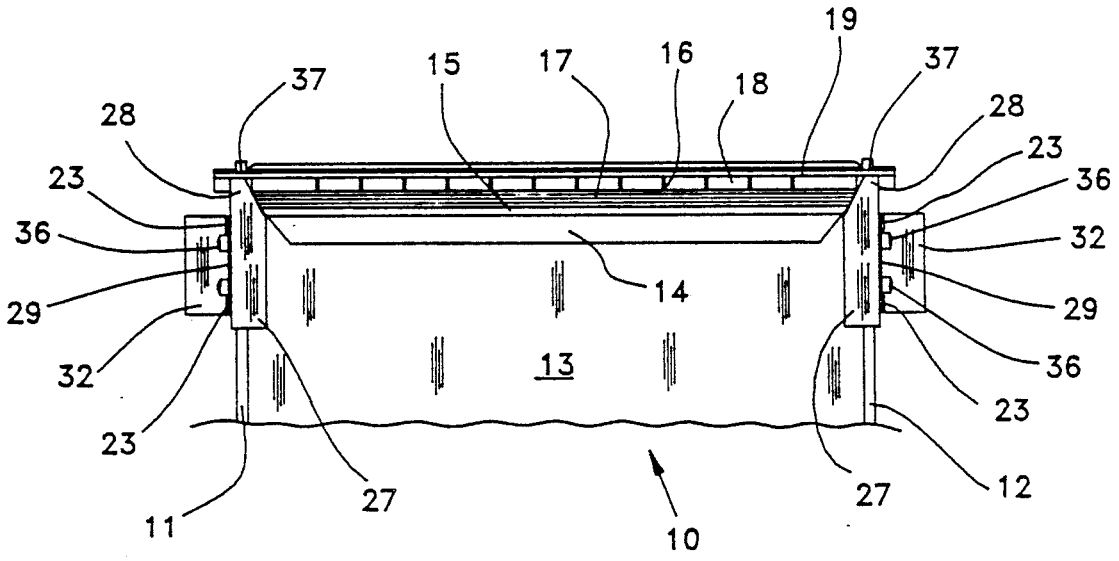
FIG. 1 is a partial bottom elevation of a mastic applicator and finishing tool with corner bead filling adapters embodying the present invention mounted on the end walls of a flat box.

Referring now to the drawings, there is illustrated a portion of a conventional mastic applicator and finishing tool to which the present invention is applicable. Reference is made to U.S. Pat. No. 2,824,442 issued to R. J. Ames in which a basic mastic applicator and finishing tool is described in detail and which, since it was introduced to the drywall construction tradesmen, has been popularity known as the "Ames" flat box. The "Ames" flat box, with minor modification, and other brand name tools of the same general configuration, are used by many contractors and tradesmen in the drywall construction business.

With reference now to FIG. 1, there is shown the mastic applying end portion of a flat box 10, sometimes hereinafter referred to simply as a tool body. The flat box 10 or tool body comprises a housing inside of which the mastic, or other wall covering material, is contained. The housing has substantially planar side walls 11 and 12 and a rigid bottom wall 13. A mastic outlet opening 14 in the bottom wall 13 extends substantially across the width of the latter. In use, the mastic is forced out of the housing by a mastic pressing plate (not visible). The pressing plate forces the mastic against an arcuate inner end wall, an edge 15 of which is visible through the outlet. The mastic is forced by the pressing plate into a receiving recess 16 that extends the length of the outlet 14. The recess 16 has a flexible tubular wall 17 secured between the arcuate wall edge 15 and a flexible guide 18 in which a troweling bar 19 is seated.

The basic flat box as illustrated and described in Ames U.S. Pat. No. 2,824,442 has wear shoes secured by screws to side wall frame members. The wear shoes are further described as having angled-shaped portions that underlie the lower sides of the side frame members and also extend under the ends of the flexible guide in which the troweling bar is mounted. The wear shoes function as friction members that ride on the wall board surfaces and also hold the flexible troweling bar guide in recesses in the side walls. Although these wear shoes are removed in fitting the adapters embodying the present invention to the end walls of the flat box, functions are retained as will be described.

Figure 4:
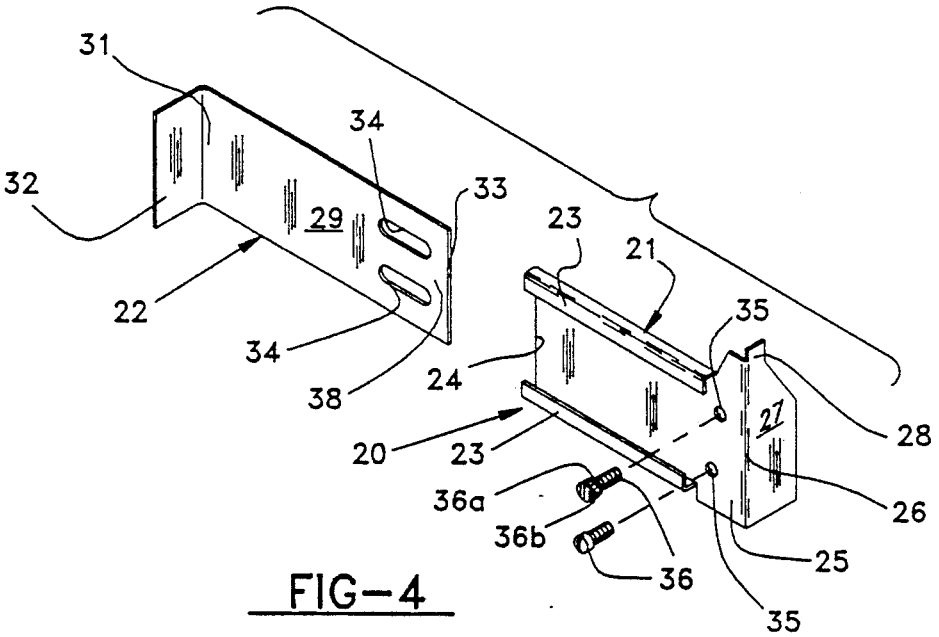
FIG. 4 is an exploded view of the adapter components.

Referring now to FIG. 4, the adapter assembly, generally designated 20, embodying the present invention comprises an elongate guide plate 21 and a corner guard member 22. The guide plate 22 has guide channels 23 at each side thereof. The guide channels 23 extend from a first end 24 of the guide plate 21 to a termination at a enlarged plate portion 25 extending laterally across a second end 26 of the guide plate 21. The guide plate 21 at its second end 26 has a substantially right angle flange portion 27 having a reduced end portion 28.

The corner guard member 22 is slidably mounted in the channels 23 of the guide plate 21. The corner guard member 22 is an elongate flat strip 29 having at one end 31 an upstanding flange 32 that serves a finger grip for sliding the corner guard in the guide plate channels 23. At its opposite end 33 the corner strip 29 has a pair of spaced longitudinally extending short slots 34. The slots 34 are close to the end 26 of the guide plate 21 for a reason to become apparent. When the corner guard strip 22 is assembled to the guide plate 21, slots 34 are aligned with screw holes 35 in the enlarged plate portion 25 of the guide plate 21.

The screw holes 35 in turn are laterally spaced to be in alignment with the screw holes (not visible) in the end walls of the flat box from which the original wear shoes were removed to accommodate an adapter assembly 20. Preferably, the screw holes 35 are of a diameter to accommodate screws 36 of the same thread diameter as used in the original wear shoe attachment. The screws 36 also preferably are of the type having a shoulder portion **36*a* of slightly larger than the diameter of the screw receiving holes 35 in the guide plate enlarged portion 25 so that the guide plates 21 can be securely tightened down against the end walls 11 and 12. The slots 34 in the corner guide 22 are of sufficient width to be slidably accommodated on the screw shoulders 36*a*. The thickness of the shoulder 36*a* is only slightly greater than the thickness of the corner guide strip 29 to provide a slip fit therebetween so as to not restrict the extension and retraction movements of the corner guide 22 in the guide plate 21 channels 23**.

Figure 2:
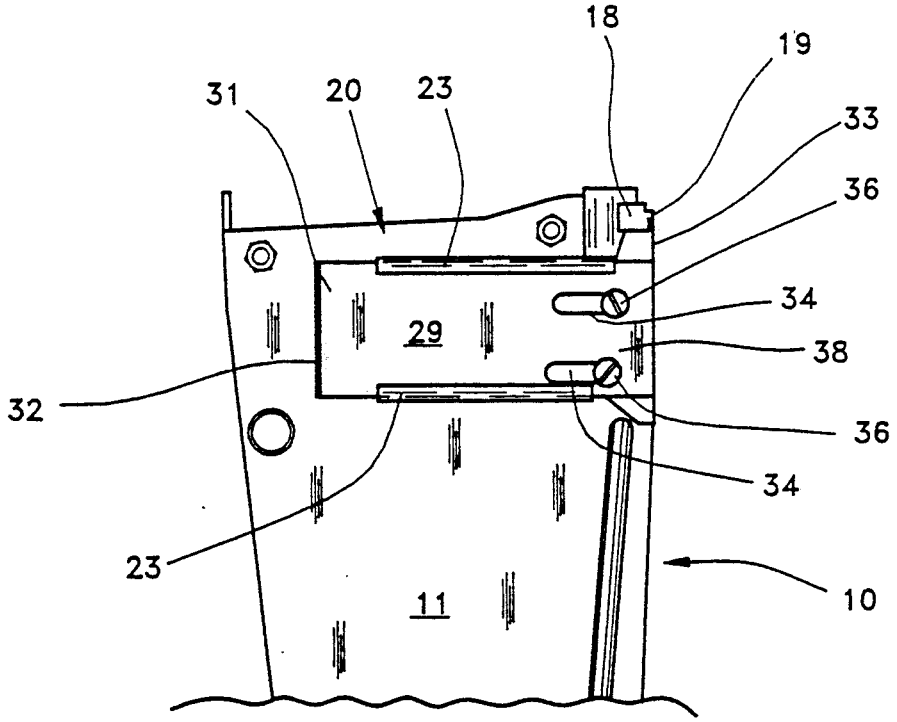
FIG. 2 is partial side elevation of an adapter mounted on an end wall of the flat box as it appears in an inoperative mode.
Figure 3:
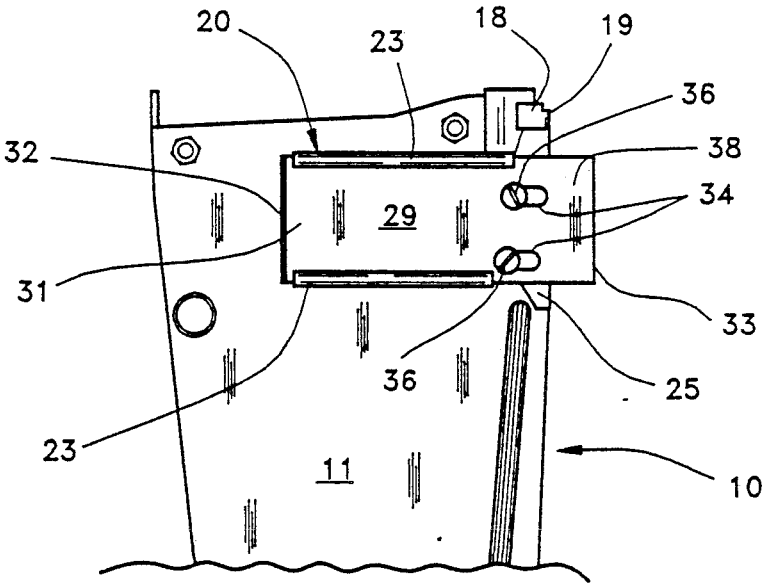
FIG. 3 is a side elevation view in part similar to FIG. 2 illustrating an adapter in an operative mode.

In FIG. 2 an adapter assembly 20 is shown with its corner guide 22 retracted so that the edge 33 of the corner guide end portion 38 is flush with the face of the wear shoe flange 27 edge. In FIG. 3, the adapter assembly 20 is shown with its corner guide 22 extended so that the edge 33 of the corner guide end portion 38 extends over the face of the wear shoe flange 27. Movement of the corner guide strip 29 to and from retracted and extended positions is easily accomplished by pushing or pulling the guide strip 29 in the desired direction by exerting pressure on the finger grip flange 32 on the end 31 of the guide strip 22.

When the end portion 38 of the corner guide strip 29 is in the retracted position shown in FIG. 2, there is no interference with the use of the flat box 10 on flat wall board surfaces. When the FIG. 3 extended position, the flat box has to be positioned with the end portion 38 on the outside of the corner bead. The flat box may be moved up or down with the end portion 38 held against the corner bead to prevent the flat box to be moved in a direction away from the corner bead. If properly held against the corner bead, a flat layer of mastic will be laid so as to properly fill the corner bead.

Figure 5:
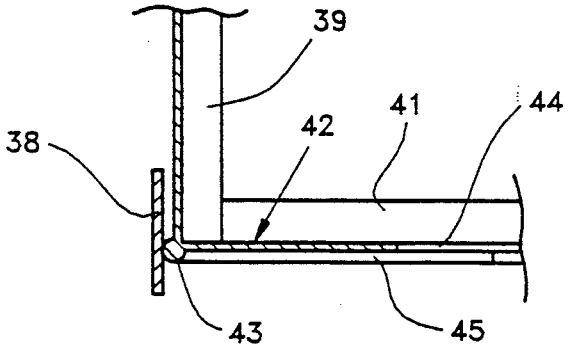
FIG. 5 is fragmentary cross sectional view of illustrating the relationship of the outside wall board corner, the corner bead and the corner guide during the filling of the corner bead with mastic.

Referring now to FIG. 5, there is illustrated a typical outside corner cross-section in which two wall board ends 39 and 49 form the corner. In accordance with current construction procedures, a right angle metal corner bead strip 42 covers the corner edge, the metal corner strip having a corner bead 43 thereon. A conventional flat box is able to lay a first layer of mastic 44 a few inches away from the corner bead strip 42 but cannot be operated to fill in the gap between the edge of the first layer and over the corner bead strip up to the corner bead. The old method is to fill the corner bead by manually troweling the mastic to a desired level with the layer 44 laid by the flat box. By having an adapter 20 on each corner of the flatbox and having the corner bead guide 22 extended on the side toward the bead to be filled, the flat box can be manipulated so that the corner guide straddles the bead 43 and guides the flat box up or down the bead 43 so that a fill layer 45 can be laid up to the bead 43 that is flush with the mastic layers terminating short of the bead strip 44. When this is done, the only manual fill that would have to done is where two corner bead strips intersect each other at an upper or lower corner of the abutting wall boards.

When the adapter assemblies 20 are mounted on the flat box end wall 11 and 12, the flange 27 on each adapter guide plate 21 functionally replaces the original wear shoes. The reduced end portion 28 on the flange 26 functions to overlie a portion of the flexible guide 18 carrying the troweling bar 19 to retain the flexible bar ends in notched recesses 37 in the end walls 11 and 12 of the flat box.

While the invention has been described with respect to a preferred embodiment thereof, it will be readily apparent to those skilled in the art that certain modifications may be made within the spirit and scope of the invention. Accordingly, the invention should not be considered limited by the description of the single embodiment, but should rather be limited only by the following claims.

I claim:

1. An adapter for attachment to a mastic applicator and finishing tool flat box for controlling the application of a layer of mastic on wallboard adjacent a corner bead, the adapter comprising:

(a) a guide plate and an outside corner guide slidably mounted on the guide plate, and means for fixedly fastening the guide plate to a corner end of a sidewall of the flat box adjacent an end of a bottom wall of the flat box having an outlet through which mastic is dispensed; and (b) the outside corner guide being slidably retained on the guide plate for movement on the guide plate between a retracted position and an extended position by overlying portions of the means for fastening the guide plate to the corner end of a sidewall of the flat box, the outside corner guide having a first end portion and a second end portion, the outside corner guide first end portion in retracted position of the corner guide on the guide plate inoperatively overlies said guide plate, and the outside corner guide first end portion in extended position of the corner guide on the guide plate being positionable to overlie the outside of a corner bead, whereby the movement of a flat box along the corner bead can be guided to limit the application of the mastic to the wallboard to filling the corner bead, the guide plate having a lateral depending end flange portion positioned to provide a friction wear shoe beneath the corner guide.

2. An adapter according to claim 1, in which:

the second end portion of the corner guide has an upstanding flange that can be gripped to move the corner guide in retracted and extended directions.

3. An adapter according to claim 1, in which:

the guide plate has longitudinally extending channels along each side thereof in which the corner guide is slidably received for retraction and extension movements.

4. An adapter according to claim 3, in which: the means for fastening the guide plate to a flat box side wall comprises retainer screws, and the corner guide has at least one longitudinal slot paralleling the guide plate channels receiving one of the guide plate retainer screws for holding the corner guide in the channels of the guide plate.

5. An adapter according to claim 4, in which:

the length of the slot in the corner guide controls the retracted and extended positions of the corner guide.

6. In combination:

A mastic applicator and finishing tool flat box for controlling the application of a layer of mastic to wallboard adjacent outside corner beads, the flat box having end walls and a bottom wall having an elongated mastic outlet extending across its width, and adapters attached to the applicator end walls for controlling the application of mastic on a wallboard surface adjacent a corner bead, comprising: a pair of elongated guide plates, means for fastening one of the pair of guide plates on each end wall adjacent the ends of the bottom wall mastic outlet, outside corner guides slidably mounted on each guide plate for selective movement between a retracted and an extended position, the corner guides each having a first end portion and a second end portion, each corner guide first end portion having a terminal edge portion which in retracted position of the corner guide lies above the bottom wall of the flat box allowing the latter to be used for normal application of mastic on flat wallboard surfaces, and either corner guide being selectively extendible below the bottom wall to enable its first end portion to straddle a selected outside corner bead to be filled with mastic as the corner guide guides the movement of the flat box along the straddled corner bead, each guide plate having a lateral end flange portion positioned to underlie a lower end wall edge and an adjacent portion of the bottom wall of the flat box, wherein the end flange portions provide friction wear shoes between the bottom of the flat box end walls and the wallborad surface being reversed by the flat box.

7. The combination flat box and adapters according to claim 8, in which:

the guide plates have longitudinally extending side channels in which the corner guides are slidable for retraction and extension movements, and the means for fastening the guide plates to the flat box end walls are retainer screws, the corner guides have longitudinally extending slots receiving the retainer screws, and the length of the slots control the retracted and extended position of the corner guides.

8. The combination flat box and adapters according to claim 7, in which:

The second end portions of the corner guides have upstanding finger grippable portions for moving the corner guides in retracted or extended directions.

* * * * *